United States Patent [19]

Yokoo et al.

[11] Patent Number: 5,015,978

[45] Date of Patent: May 14, 1991

[54] ELECTROMAGNETIC RELAY

[75] Inventors: Kiyotaka Yokoo; Hideki Hitachi; Matsujiro Ikeda, all of Tokyo, Japan

[73] Assignee: NEC Corporation, Japan

[21] Appl. No.: 198,476

[22] Filed: May 25, 1988

[30] Foreign Application Priority Data

| | | | |
|---|---|---|---|
| May 29, 1987 | [JP] | Japan | 62-137265 |
| Jun. 2, 1987 | [JP] | Japan | 62-139150 |
| Sep. 14, 1987 | [JP] | Japan | 62-231626 |
| Oct. 22, 1987 | [JP] | Japan | 62-267800 |
| Oct. 30, 1987 | [JP] | Japan | 62-167024[U] |
| Oct. 30, 1987 | [JP] | Japan | 62-276401 |

[51] Int. Cl.[5] ..... H01H 51/22

[52] U.S. Cl. ..... 335/78; 335/80; 335/85; 335/128

[58] Field of Search ..... 335/78–85, 335/128, 229, 230, 267

[56] References Cited

U.S. PATENT DOCUMENTS 4,499,442 2/1985 Kamo et al. .

4,695,813 9/1987 Nobutoki et al. ..... 335/78

FOREIGN PATENT DOCUMENTS 59-211929 11/1984 Japan .

*Primary Examiner*—Leo P. Picard

*Assistant Examiner*—L. Donovan

*Attorney, Agent, or Firm*—Laff, Whitesel, Conte & Saret

[57] ABSTRACT

A miniature flat relay comprising upper and lower insulating housing member. The lower member has a coil which snugly fits therein. The coil contains a core with a centrally located permanent magnet which energizes a U-shaped magnetic structure and provides a fulcrum for seesaw mounting an elongated armature. Movable electrical contacts project from opposite ends of the armature. A central section of the contacts forms hinge sections which project therefrom in order to secure the armature at said fulcrum. The armature may be made either bi-stable or monostable.

5 Claims, 5 Drawing Sheets

ELECTROMAGNETIC RELAY

BACKGROUND OF THE INVENTION

This invention relates to an electromagnetic relay having a flat configuration with a lower height.

DESCRIPTION OF THE PRIOR ART

An example of prior art electromagnetic relays of this type is explained by referring to FIGS. 1A and 1B. The relay comprises an insulating base member 40 serving as a lower coil spool. Two exterior lead terminals 43 of a magnetic member have stationary electric contacts 41 and permanent magnets 42 fixed thereon. A common terminal 44 is made of a non-magnetic member. The outer lead terminals 43 and the common terminals 44 are fixed on the insulating base member 40. Opposing internal ends of the external lead terminals 43 confront corresponding ends of a seesaw-movable armature 45. A movable contact spring 47 with movable electric contacts 46 is fixed above the armature 45. Two hinge springs 48 of the spring 47 are fixed on the common terminals 44. An insulating cover 49, serving as an upper coil spool, is fixed on the base member 40 to support a winding or coil 50. An example of relays having the above-mentioned structure is disclosed, for instance in U.S. Pat. No. 4,342,016.

However, the above-described conventional electromagnetic relay has structural problems concerning the following points:

(1) Since the armature 45 is directly excited by the coil 50, a space is required within the winding portion of the cover 49 for allowing a movement of the armature 45, thereby failing to achieve a higher coil magnetization efficiency.

(2) Since leakage magnetic flux is large and the magnetic flux path is not closed enough, a higher magnetic circuit efficiency cannot be attained.

(3) After winding of the coil 50 is completed, the only means for adjusting the sensitivity of the relay is a adjustment of the magnetization.

SUMMARY OF THE INVENTION

An object of this invention is to provide an electromagnetic relay which is free from the above-mentioned problems which are encountered in the prior art. Another object is to effectively utilize generated magnetic fluxes and improve the coil magnetization efficiency. Still another object is to provide a relay which can be driven at higher sensitivity and low power consumption.

Another object of this invention is to provide an electromagnetic relay having a flat configuration so as to reduce the height in packaging.

Still another object of this invention is to provide an electromagnetic relay which is adjustable in sensitivity when may have a spring load adjustment even after it is assembled.

Still another object of this invention is to provide an electromagnetic relay having a higher reliability in electric contacts.

Accordingly, in order to achieve the above-mentioned objects, the electromagnetic relay of this invention comprises:

a coil assembly having a permanent magnet placed with one of the magnetic poles in contact with the center of a U-shaped core with a coil thereon;

an armature assembly having two ends which confront and oppose both ends of the core, a hinge spring supports the armature for a seesaw movement of the armature as opposite ends thereof come to contact with or separate from the confronting ends of the core respectively, and movable contact springs cooperating with the seesaw movement of the armature, the armature, the hinge spring and the movable spring being integrally fixed on an insulating molded member; and an insulating base having a box like configuration with an opening on the top thereof and including stationary contact terminals, the stationary contacts opposing movable contacts of the their confronting movable contact springs and common terminals to be connected to one end of the hinge springs, when the coil assembly is placed within the opening and when the armature assembly is arranged in a manner so that the other magnetic pole of the magnet acts as a supporting point for the seesaw movement of the armature.

BRIEF DESCRIPTION OF THE DRAWINGS

The above and other objects and features of this invention will become clearer from the detailed description when taken in conjunction with the attached drawings in which.

In the drawings, the same reference numerals denote the same structural elements.

DESCRIPTION OF THE PREFERRED EMBODIMENTS

Figure 1A:
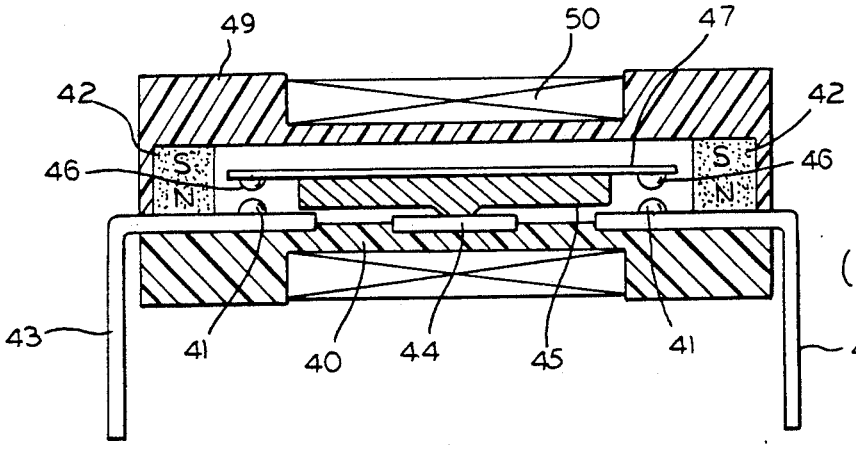
FIG. 1A (PRIOR ART)
FIGS. 1A and 1B are vertical sectional and plan views respectively showing a prior art electromagnetic relay.
Figure 1B:
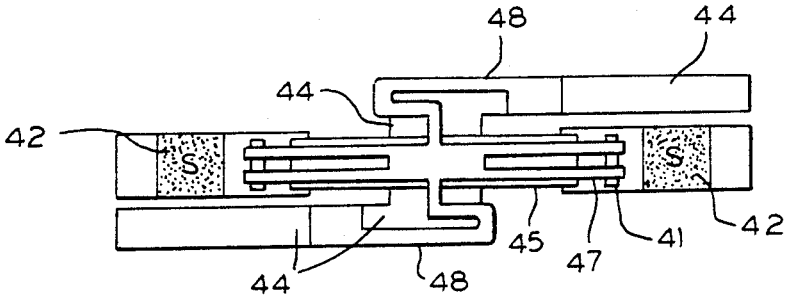
FIG. 1B (PRIOR ART)
Figure 2:
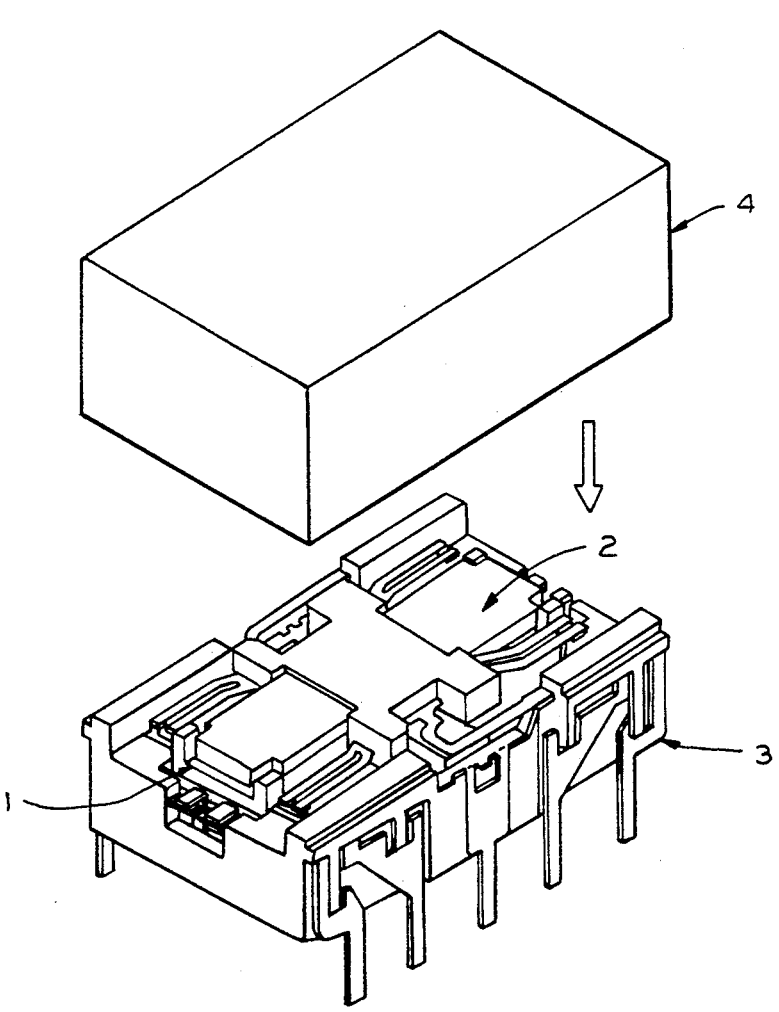
FIG. 2 is a perspective view to showing an embodiment of this invention.
Figure 3:
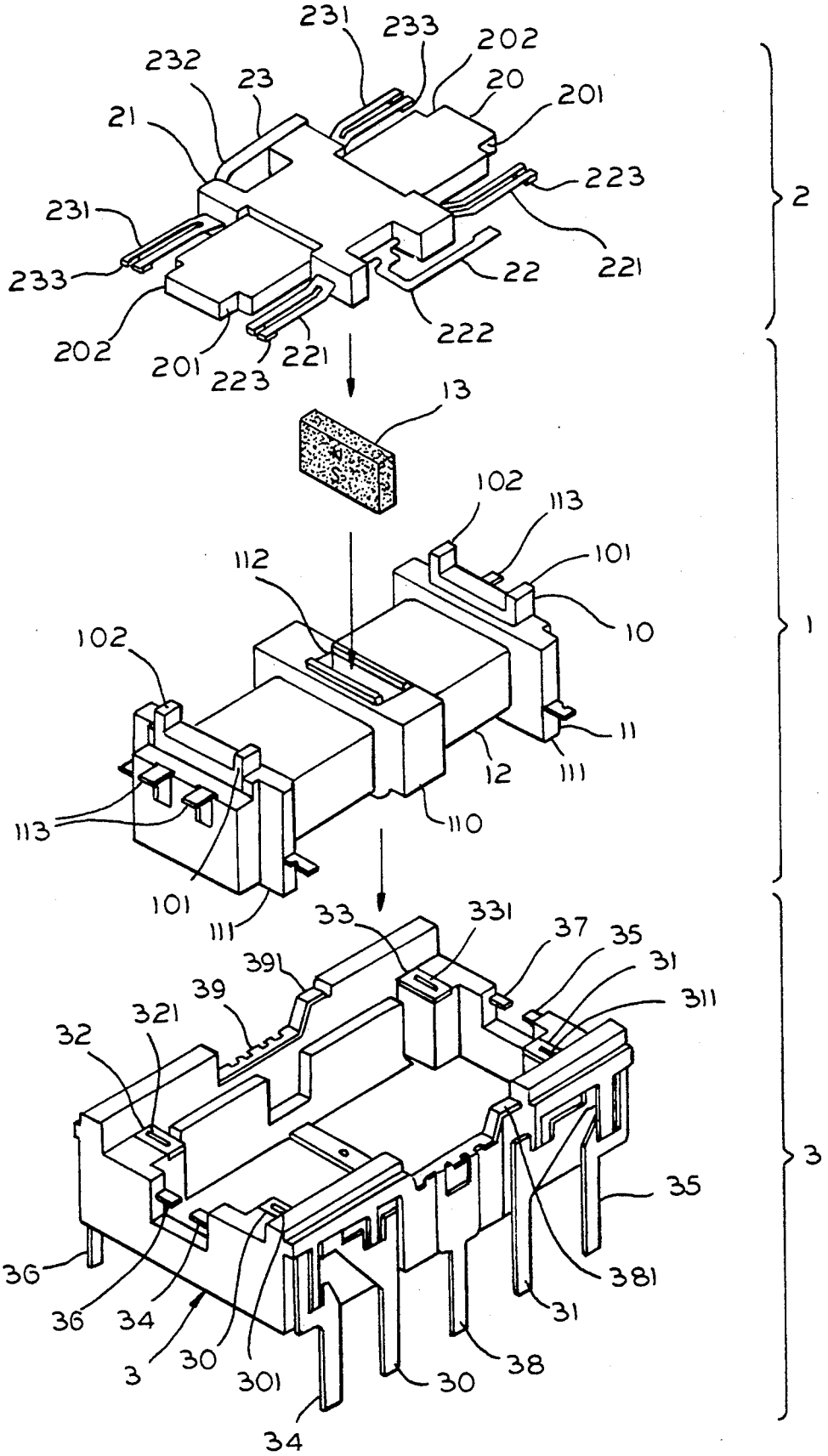
FIG. 3 is an exploded view of FIG. 2.

Referring to FIGS. 2 and 3, an embodiment of the invention comprises a coil assembly 1, an armature assembly 2, an insulating base 3 and a cover 4.

The coil assembly 1 comprises a magnetic iron core 10 of the shape of a letter U, a coil spool 11 formed by insert-molding the core 10, a coil 12 externally wound around the spool 11, and a permanent magnet 13. Projections 101 and 102 are formed on both sides of the two ends of the U-shaped core 10. The magnet 13 is inserted into a hole 112 of a central flange 110 of the spool 11. One of the magnetic poles (lower end) is fixed at the center of the core 10. Two pairs of coil terminals 113 are provided on each of the flanges 111, on opposite ends of the spool 11.

The armature assembly 2 comprises an armature 20 having a flat plate formed of a magnetic member. An insulating molded member 21 is formed by molding the armature 20 at the center thereof. Two electrically conductive spring members 22, 23 are respectively provided with movable twin contact spring sections 221, 231, having movable twin electric contacts 223 and 233 on both sides and hinge spring sections 222 and 223 which are of a crank form. Two notches 201, 202 are formed in longitudinal directions on opposite ends of the armature 20 in the. Notches 201, 202 correspond to the shapes of the projections 101, 102 of the core 10. The spring members 22, 23 are fixed on both sides of the armature 20 with the molded member 21 made of an insulating resin, such as a plastic material, to integrally hold the armature 20 and spring members 22, 23. The armature 20 is insulated from the members 22 and 23.

The base 3 comprises a flat box-like member with an opening on the top thereof. The base 3 has four corners with four pairs of stationary contact terminals 30 through 33 respectively having electric contacts (stationary contacts) 301, 311, 321, 331, four coil terminals 34 through 37 and two common terminals 38, 39. The coil assembly 1 is internally fixed to the base 3 with a material, such as an adhesive, while the coil terminals 113 of the spool 11 are fixed to the coil terminals 34 through 37 of the base 3 by soldering, etc.

The armature assembly 2 is placed from above so that the center lower surface of the armature 20 comes to contact with the upper magnet pole of the magnet 13. The ends of the hinge spring sections 222 and 232 are mounted by soldering, etc. to the fixing sections 381 and 391 of the common terminals 38 and 39 of the base 3 respectively. When the cover 4 (FIG. 2) is placed from above, the above-mentioned members 1, 2, 3 and 4 form an electromagnetic relay. In this state, the armature 20 can move or seesaw on the upper end of the magnet 13 with opposing ends moving upwardly and downwardly due to the seesaw action. The armature movement is supported by elasticity given by the hinge spring sections 222 and 232 fixed on the common terminals 38, 39 of the base 3, on the ends thereof.

Figure 4A:
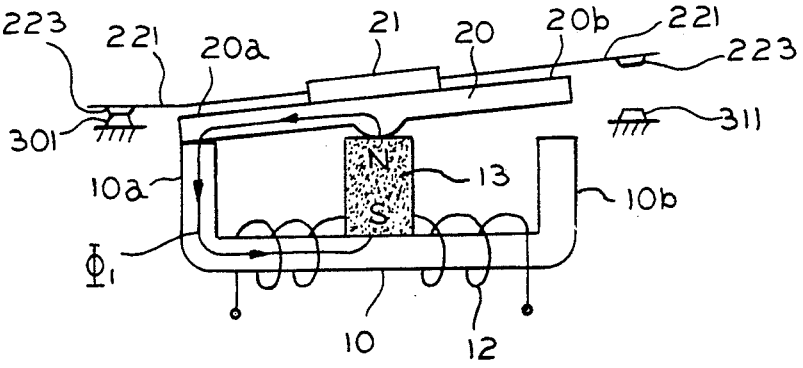
FIGS. 4A to 4C are explanatory views of the operational principles of the relay shown in FIG. 2.

The operational principle of the relay will now be described referring to FIGS. 4A through 4C. As described in the foregoing, a permanent magnet 13 is provided at the center of the inside of the iron core 10. Opposing both ends 10*a* and 10*b* of the core 1 are positioned the confronting ends 20*a*, 20*b* of the armature 20 in a manner which enables the seesaw movement. FIG. 4A shows the state when the coil 12 is not excited, the armature 20 is attracted to the side of the core 10*a* by the magnetic flux $\phi_1$ generated by the magnet 13.

Figure 4B:
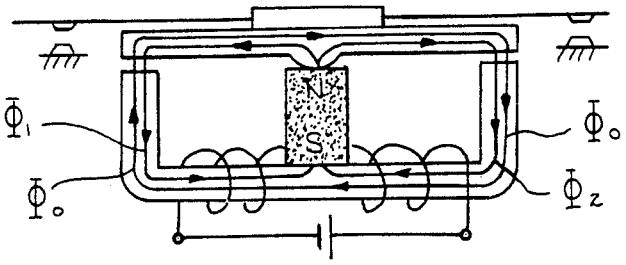
Figure 4C:
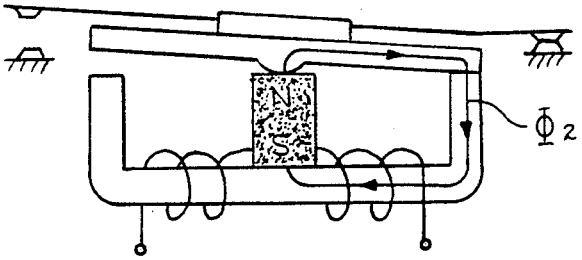

FIG. 4B shows the state when the coil 12 is excited. The magnetic flux $\phi_0$ generated on the core 10 by the coil excitation overcomes the magnetic flux $\phi_1$ on the side of the armature end 20*a*. The magnetic flux $\phi_0$ is added to the magnetic flux $\phi_2$ of the magnet 13 on the other side of the armature end 20*b*. Therefore, the armature 20 is made to swing clockwise around the fulcrum formed by the upper end of the magnet 13 to cause the armature end 20*b* and the core 10*b* to contact each other. At this state, even if the excitation from the coil 12 is suspended as shown in FIG. 4C, the armature 20 becomes and remains attracted toward the core end 10*b* responsive to the magnetic flux $\phi_2$ of the magnet 13.

When the direction of the electric current of the coil 12 is reversed, the state is inverted to become that shown in FIG. 4A. The above-mentioned movement indicates a self-holding-type (bistable-type) relay. The movable contact springs 221 and 231 are integrally formed with the armature 20. Therefore along with the seesaw armature movement, movable contacts 223 (and 233) and stationary contacts 301, 311 (and 321, 331) come into contact with or become separated from each other to switch electric circuits.

The displacement of the armature 20 on the end which is remote from the core 10 largely affects the dielectric strength between electric contacts. More particularly, the larger the gap between the armature end and the core end, the larger becomes the dielectric strength. However as the gap increases, the magnetic reluctance increases to increase the leakage flux on the attraction side of armature 20 when the seesaw position of the armature is about to be inverted. This induces a drastic drop of magnetic attraction force. The insufficient magnetic attraction reduces the sensitivity of the relay.

Figure 5A:
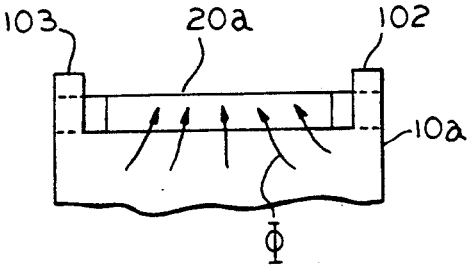
FIGS. 5A and 5B are views showing the contact state and separation state between the armature and the core end shown in FIG. 3.
Figure 5B:
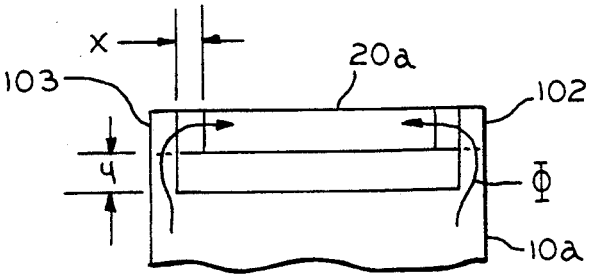

The sensitivity problem is solved in this embodiment by the provision of the notches 201, 202 (FIGS. 3, 5) of the armature 20 and the projections 101, 102 of the core 10. More particularly, in the structure of this embodiment, when the armature end 20*a* is in contact with the core end 10*a* (FIG. 5A), the magnetic flux $\phi$ passes through the lower side of the end 20*a* (contact surface) where the magnetic reluctance is minimum. When the armature end 20*a* is separated from the core end 10*a* (FIG. 5B), the magnetic flux $\phi$ is likely to pass from projections 101, 102 to the side of the end 20*a*. Even when the armature end 20*a* is separated from the upper surface of the core end 10*a* (contact surface), the gap x does not change between the side surface of the armature end 20*a* and the projections 101, 102 which act as side yokes. Therefore, a path of the magnetic flux $\phi$ is constantly secured to reduce leakage flux. Even if the gap y is large (in other words, the dielectric strength is large), the magnetic attraction force is prevented from drastically decreasing when the armature seesaw position of the is inverted. As a result, a relay can be realized with higher sensitivity and larger dielectric strength between contacts.

Figure 6A:
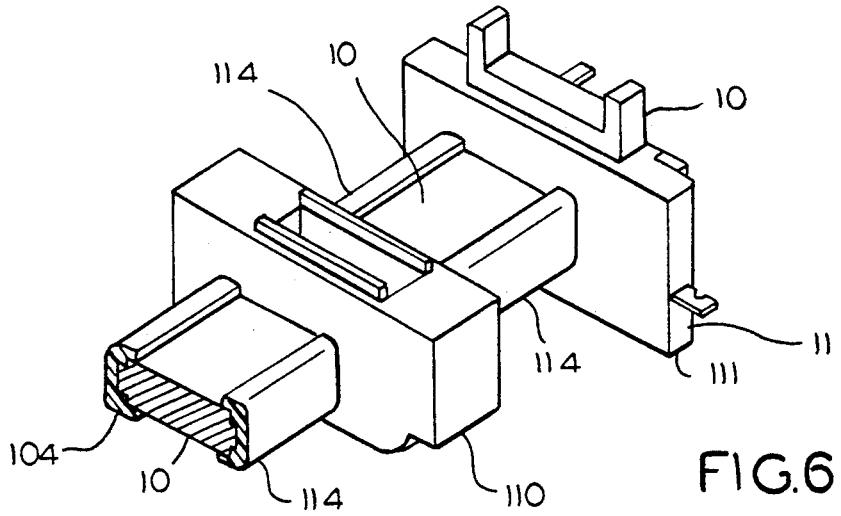
FIGS. 6A and 6B are a partially cut-out perspective view and a sectional view respectively to showing details of the coil spool shown in FIG. 3.
Figure 6B:
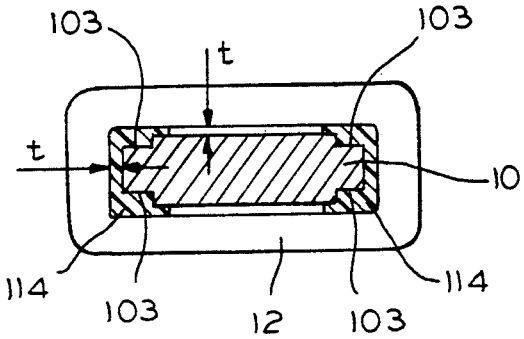
Figure 7:
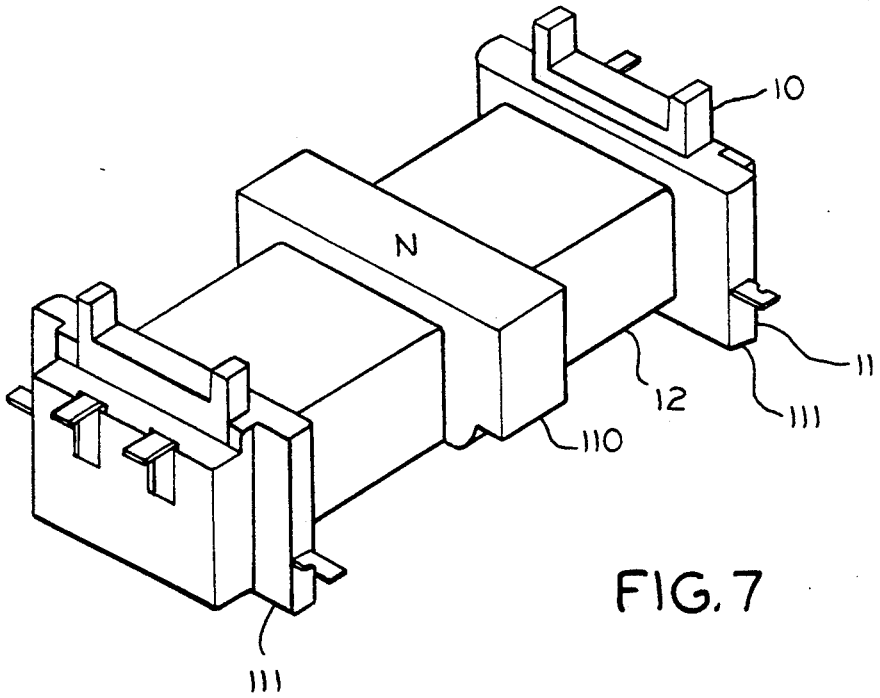
FIG. 7 is a perspective view showing another example of the coil spool shown in FIG. 3.

Referring to FIGS. 6A, 6B and 7, details of a modification of the coil spool will be described. In FIGS. 6A and 6B, the iron core 10 which is wound with coil 12 is partially covered with the molded section 114, and partially exposed in the spool 11. Respective flanges 110, 111 and a molded section 114 are formed by insert-molding the core 10. More particularly, the core 10 is substantially formed in the shape of a letter U by bending both ends of a flat plate. Four dents on depression 103 are formed in the section wound with coil 12 by partially pressing the four corners of the core 10. The dents or depressions 103 are provided in order to facilitate an application of resin along the entire length of the core 10 when resin is injected through several injection ports into a metal die used in insert-molding. In the cross section of the core 10, the dents 103 and two side surfaces (shorter sides) are covered by the molded section 114 while two major surfaces (longer sides) are largely exposed. On the major surfaces, the surface area of the molded section 114 is raised higher by the thickness t than the exposed surface of the core 10. The molded section 114 is given the thickness t on the side surfaces of the core 10.

When the coil 12 is wound around the spool 11 of the above structure as shown in FIG. 6B, an insulating void space having the depth t is created on the major surface between the core 10 and the coil 12. The thickness t which is equivalent to the thickness of the wound section can be reduced to about 0.1 millimeters if PBT (polybuthylene terephthalate) is used. Since the area which should be molded is small on the side surface of the core 10, a mold of a smaller thickness t can be formed. In the prior art the core 10 is entirely molded. Thus, the minimum thickness t cannot be reduced to become less than about 0.3 millimeters. In this embodiment, the coil 12 and the core 10 can be placed closer to each other. The number of winding turns in the same space can be increased so that the coil excitation efficiency (coil constant) can be improved by 40% over the prior art. Therefore, this spool structure contributes to an achievement of a relay with higher sensitivity.

FIG. 7 shows another example of the spool wherein the permanent magnet 13 is omitted from the structure by forming the central flange 110 with a plastic magnet which is polarized vertically.

Figure 8A:
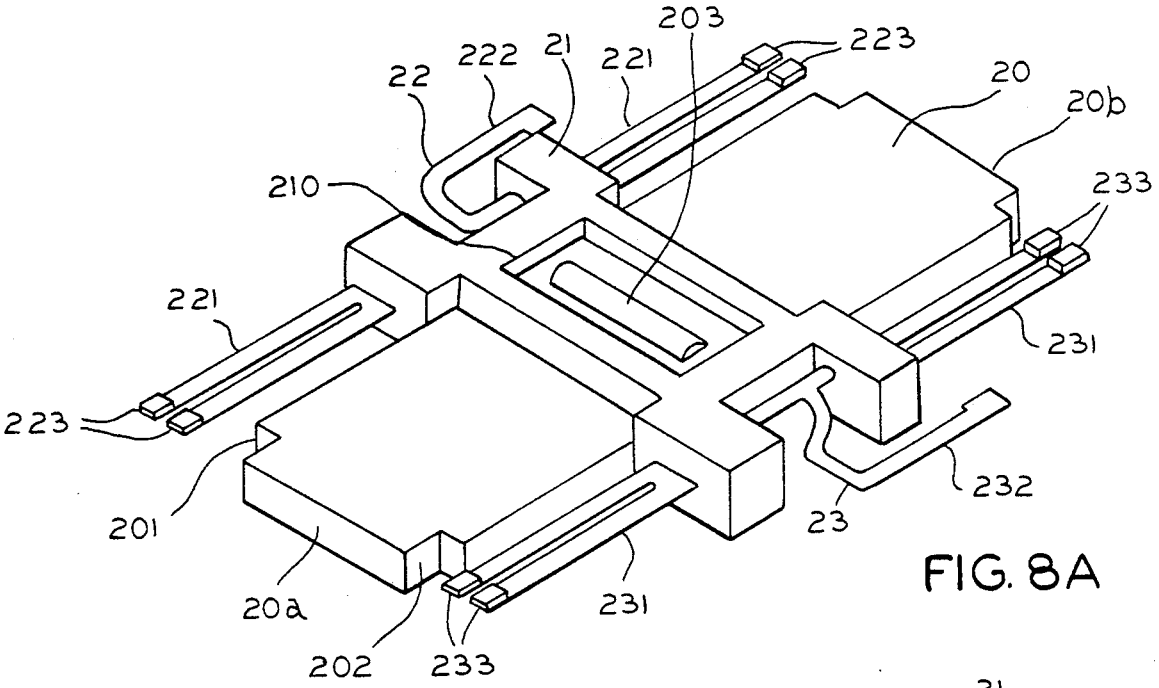
FIGS. 8A and 8B are a perspective view and a vertical sectional view respectively showing details of the embodiment of FIG. 3.
Figure 8B:
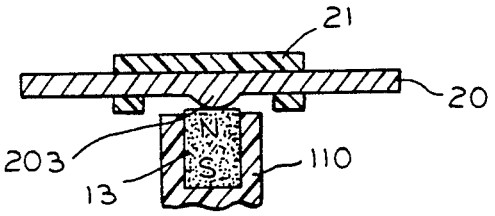

The armature assembly 2 will now be described in more detail referring to FIGS. 8A and 8B. The hinge springs 222 and 232 are electrically conductive. These springs support the seesaw movement of the armature assembly 2 and the movable contacts 223 and 233 of the movable contact spring members 221 and 231. Thus, the hinge springs 222 and 232 can act as common electrical terminals for the transfer switching contacts. As the hinge springs 222 and 232 which are formed in the shape of a crank are exposed before the cover is placed from above, they can be adjusted for optimal loads, even after assembly, simply by bending them.

A window 210 is formed on the lower surface of the molded member 21 to expose the lower central surface of the armature 20. Within the window 210 is formed a supporting projection 203 by press-working the armature 20. The projection 203 is encircled by the molded section 21 and comes in contact with the magnet 13 to become a supporting point or fulcrum for the movement of the armature 20. The molded member 21 prevents powders which are generated by frictional movement from entering the electric contacts as shown in FIG. 8B. This eliminates an adverse effect on said contacts which may otherwise be caused by the generated powders (insulator) resulting from friction to attain a higher reliability in the relay.

Figure 9:
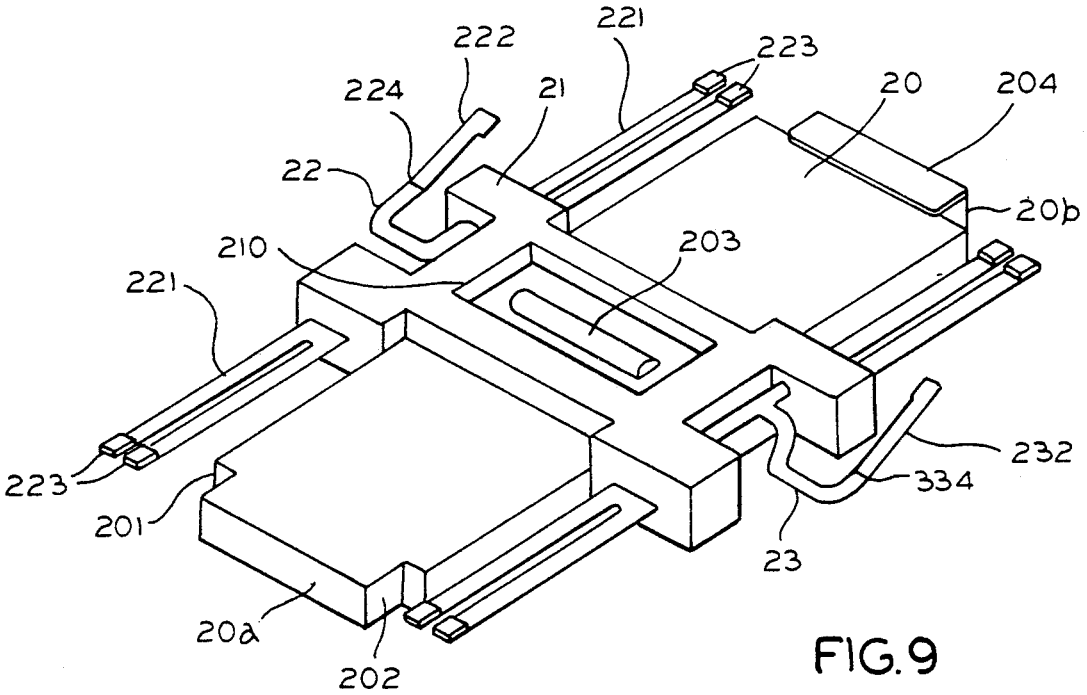
FIG. 9 is a perspective view to show, another embodiment of the invention.

Although all the embodiments are described as self-holding-types of relays in the foregoing statement, this invention can also be readily applied to current-holding-type (monostable-type) relays in a manner described below. The relay can be structured by causing the armature 20 to be attracted to either side of the core when the coil is not excited. A residual plate 204 of a non-magnetic material is fixed on one end 20*b* of the armature 20 as shown in FIG. 9. The balance is disturbed by increasing the magnetic reluctance from ends of the core 10. Alternatively, hinge springs 222 and 232 in a crank form are bent (224, and 234) to apply the spring pressure generated when the ends of these springs 222 and 232 are soldered to the neutral common terminals of the base 3 for contacting the armature end 20*a* and the core end 10*a* when the coil is not excited to achieve the same effect. Either method can be used to achieve the same effect.

What is claimed is:

1. An electromagnetic relay comprising:

a coil assembly having a permanent magnet arranged in a manner to cause one of its magnetic poles to make contact with the center of a U-shaped core on which said coil is wound;

an armature assembly including an armature having opposite ends mounted to oppose opposite ends of said core, hinge springs for supporting said armature for undertaking a seesaw movement wherein either end of the armature comes into contact with or separates from the opposite ends of said core respectively, and movable contact springs cooperating with the seesaw movement of said armature, and the armature, the hinge spring and the movable spring being integrally fixed with an insulating molded member; and an insulating base having a box-like shape with an opening on the top thereof and including stationary contact terminals having stationary contacts positioned to oppose movable contacts of said movable contact springs and including common terminals to be connected to one end of said hinge springs, when said coil assembly is placed within said opening and when said armature assembly is arranged in a manner so that the other magnetic pole of said magnet acts as a supporting fulcrum for the seesaw movement of said armature;

each of the opposite ends of said U-shaped core having two projections provided on both sides of surfaces on the ends of said core;

each of the opposite ends of said armature having two notches formed in shapes corresponding to said projections to form an air gap between side surfaces of said armature ends and each of said projections whereby a path of the magnetic flux is formed by said air gap when each of said armature ends separates from the core end.

2. An electromagnetic relay comprising:

a coil assembly having a permanent magnet arranged in a manner to cause one of its magnetic poles to make contact with the center of a U-shaped core on which said coil is wound;

an armature assembly including an armature having opposite ends mounted to oppose opposite ends of said core, hinge springs for supporting said armature for undertaking a seesaw movement wherein either end of the armature comes into contact with or separates from the opposite ends of said core respectively, and movable contact springs cooperating with the seesaw movement of said armature, and the armature, the hinge spring and the movable spring being integrally fixed with an insulating molded member; and an insulating base having a box-like shape with an opening on the top thereof and including stationary contact terminals having stationary contacts positioned to oppose movable contacts of said movable contact springs and including common terminals to be connected to one end of said hinge springs, when said coil assembly is placed within said opening and when said armature assembly is arranged in a manner so that the other magnetic pole of said magnet acts as a supporting fulcrum for the seesaw movement of said armature;

each of the opposite ends of said U-shaped core having two projections provided on both sides of surfaces on the ends of said core;

each of the opposite ends of said armature having two notches formed in shapes corresponding to said projections to form an air gap between side surfaces of said armature ends and each of said projections whereby a path of the magnetic flux is formed by said air gap when each of said armature ends separates from the core end; and said U-shaped core having dents on corners of a section where the coil is wound, said section having a polygonal cross section, portions of said core near the dents being molded with resin to form a coil spool, at least one of the surfaces of said core being exposed, and a surface of said mold being raised higher than the surface of said core on both sides of the exposed core surface.

3. An electromagnetic relay comprising:

a coil assembly having a permanent magnet arranged in a manner to cause one of its magnetic poles to make contact with the center of a U-shaped core on which is wound a coil;

an armature assembly including an armature having opposite ends mounted to oppose opposite ends of said core, hinge springs for supporting said armature for undertaking a seesaw movement wherein either end of the armature comes into contact with or separates from the opposite ends of said core respectively, and movable contact springs cooperating with the seesaw movement of said armature, and the armature, the hinge spring and the movable spring being integrally fixed with an insulating molded member; and an insulating base having a box-like shape with an opening on the top thereof and including stationary contact terminals having stationary contacts positioned to oppose movable contacts of said movable contact springs and including common terminals to be connected to one end of said hinge springs, when said coil assembly is placed within said opening and when said armature assembly is arranged in a manner so that the other magnetic pole of said magnet acts as a supporting point fulcrum for the seesaw movement of said armature; and said U-shaped core having dents on corners of the coil wound section having a polygonal cross section, portions of said core near the dents being molded with resin to form a coil spool, and at least one of the surfaces of said core being exposed, and the surface of said mold being raised higher than the surface of said core on both sides of the exposed core surface.

4. An electromagnetic relay comprising:

a plate-like core wound with a coil which is formed as a whole in the shape of a letter U, each of the opposite ends of the core having projections on both sides of its upper surface to form a U-shaped pole piece;

a permanent magnet in contact with said core;

a plate-like armature mounted to be moved in a seesaw manner so as to cause opposite ends thereof to make contact with or to separate from opposite ends of said core;

movable contact springs moved in accordance with movement of said armature in the seesaw movement; and a base having stationary contacts with which movable contacts of said movable contact springs come into contact or to separate from in said seesaw movement;

ends of said armature passing between said projections provided on both sides of the core end when the armature ends come into contact with or separate from said core ends.

5. A miniature flat relay comprising:

an elongated armature supported for seesaw movement on a permanent magnet fulcrum embedded in a coil assembly;

electrical contacts projecting from opposite ends of said armature and having centrally extending contact hinge members on opposite sides of said armature for securing said armature in said support for said seesaw movement;

an insulating support base for holding electrical contacts in confrontation with said projecting contacts and for anchoring said centrally extending contact hinge members, the base having a central opening for receiving said coil assembly with said permanent magnet positioned to provide said fulcrum for said seesaw action;

a U-shaped core extending through said coil assembly with said permanent magnet centrally positioned in said U-shaped core, whereby opposite ends of U-form pole pieces of the core, and said ends of said elongated armature being positioned to form air gaps at said opposite ends;

said armature and said core being shaped at the air gap to form two air gaps, one of said air gaps being centrally located at the end of said armature to be closed when said armature seesaws against the polepieces, and the other of said air gaps being located at sides of said armature to form a minimum gap when said armature seesaws away from said polepiece.

* * * * *